United States Patent [19]

Ginn, Jr. et al.

[11] Patent Number: 4,805,438

[45] Date of Patent: Feb. 21, 1989

[54] HEMMING DIE FIXTURE FOR METAL PRESSES

[75] Inventors: Albert R. Ginn, Jr., Magnolia; Lynn Widrick, Spring, both of Tex.

[73] Assignee: Metal Building Components Incorporated, Houston, Tex.

[21] Appl. No.: 22,219

[22] Filed: Mar. 5, 1987

[51] Int. Cl.[4] ..... B21D 17/02

[52] U.S. Cl. ..... 72/384; 72/389; 72/414; 72/477; 72/442

[58] Field of Search ..... 72/384, 389, 414, 413, 72/477, 478, 442, 447, 441

[56] References Cited

U.S. PATENT DOCUMENTS

| | | | |
|---|---|---|---|
| 2,707,510 | 5/1955 | Gershon . | |
| 2,936,808 | 10/1956 | Felt . | |
| 3,509,757 | 10/1984 | Hanni | 72/414 |
| 3,681,994 | 8/1972 | Zbornik | 72/389 |
| 3,845,655 | 11/1974 | Krieg | 72/389 |
| 3,983,735 | 10/1976 | Berry | 72/312 |
| 4,305,340 | 12/1981 | Iwaki et al. . | |
| 4,392,373 | 7/1983 | Clark | 72/384 |
| 4,468,946 | 9/1984 | Driear | 72/379 |
| 4,484,467 | 11/1984 | Kitano et al. | 72/379 |
| 4,509,357 | 4/1985 | Zbornik | 72/384 |
| 4,557,135 | 12/1985 | Ragettli et al. | 72/420 |

FOREIGN PATENT DOCUMENTS

| | | | |
|---|---|---|---|
| 8500410 | 9/1986 | Netherlands | 72/389 |

OTHER PUBLICATIONS

"Power Brake Dies Inc.", Catalog 480, 1974, p. 5.

*Primary Examiner*—David Jones
*Attorney, Agent, or Firm*—Arnold, White & Durkee

[57] ABSTRACT

An improved hemming die fixture, used in conjunction with a sheet metal press, is disclosed. The fixture is attachable to the ram, or ram assembly, of a metal press and carries with it a hemming die. The fixture is automatically displacable between working and standby positions. When not in use, the hemming die fixture is placed in a standby position wherein it is placed parallel to the ram of the press, and away from a primary die on the bottom of the ram. When required, the fixture may be actuated to place a hemming die parallel to, and below, the primary die located along the bottom of the ram. The hemming die then coacts with the work table, or second flat hemming die, of the press to form a hem along a longitudinal edge of a piece of sheet metal in a plane other than the plane in which a full bend is first formed along the edge of the sheet metal.

12 Claims, 2 Drawing Sheets

HEMMING DIE FIXTURE FOR METAL PRESSES

BACKGROUND OF THE INVENTION

The present invention relates generally to metal presses used to form sheet metal into various shapes, and in particular to an improvement in a press used to form a hem along a longitudinal edge of a piece of sheet metal.

A hem is a seam wherein the edge of a piece of material is folded back onto the body of the material to form a stronger edge along the piece of material. In sheet metal fabricating, a hem is formed when a longitudinal edge of a piece of sheet metal is bent back toward the body of the sheet metal and flattened down to form a flat border along the edge of the sheet. This flat border, or hem, has a thickness which is slightly greater than twice the thickness of the sheet metal.

In the past, a hem has been formed along the edge of a piece of sheet metal by a two step process. A primary bending die has been provided along the lower longitudinal edge of the ram of a metal press, or press brake. This primary die is roughly "U-shaped" in cross section. A matching bottom die has been provided on the working surface of the work table. This bottom die is roughly "V-shaped" in cross section and is adapted to receive the body of the primary die within the interior of the "V". The coaction of the primary and bottom dies form what is known as a "full bend" along an end of the sheet metal. A "full bend" is a roughly hook-shaped bend formed along the edge of the sheet metal, the actual edge of the sheet comprising the end of the hook which is directed back over the body of the sheet.

Initially, an individual work piece was placed on a working surface of the work table of a metal press. The metal press, or press brake, was then engaged so that the primary die of the large, roughly rectangular ram was lowered into contact with the bottom die provided along the work table. When the ram of the press brake was lowered so that the primary die engaged the bottom U-shaped die, the sheet metal placed on top of the bottom die was deformed into a "full bend".

In the past, if it was necessary to form a hem on a large number of pieces of sheet metal, a full bend was first formed on each individual piece. Then, after a full bend had been formed on each individual piece a beam-shaped fixture was manually lifted into place, and bolted onto the face of the ram of the press brake. The beam-shaped member was positioned so that the bottom most portion of the beam coacted with the work table of the press brake. Each individual piece of sheet metal was again inserted into the press brake so that the longitudinal edge of the sheet, having the full bend formed on it, was flattened between the bottom of the beam-shaped fixture and the work table as the ram was again lowered.

The above described method of forming a hem is cumbersome and time consuming. Further, the above method is labor intensive in that it requires a number of workers to lift the beam shaped fixture into place and hold it there while it is bolted to the face of the ram. A similar number of workers are required to remove the beam-shaped fixture from the ram. Finally, the above method of forming a hem has proven to be inefficient if the pieces of sheet metal must undergo further fabrication or treatment after the hem has been formed. Production on the individual pieces is held up until the entire lot of sheet metal undergoes both the full bend and hemming procedures.

Thus, the prior art methods and devices used to form a hem on a piece of sheet metal have demonstrated various disadvantages which have heretofore not been overcome.

SUMMARY OF THE INVENTION

The present invention overcomes the previously unsolved problems associated with producing a hem on a piece of sheet metal, and provides a method and apparatus which may be used to quickly and efficiently form a hem on a number of pieces of sheet metal in a fraction of the time normally required. Further, an apparatus according to the present invention provides a hemming fixture which may be quickly and inexpensively added to existing press brakes in order to practice the method of the invention.

In accordance with the present invention, a hemming fixture, or secondary ram is mounted on the ram, or ram assembly, of a metal press to form a hem on a piece of sheet metal after the primary and bottom dies have been used to form a full bend on the sheet metal. A pair of mounting brackets are used to attach the fixture to the ram, or first ram, of the press. The mounting brackets are attached to the front side of the ram in an opposed, substantially vertical relation. A separate vertical positioning brace is attached to each mounting bracket so that the brace may slide up and down along its respective bracket.

A vertical support member is attached to each vertical positioning brace. One end of the vertical support member is rotatably attached to its vertical positioning brace so that a hemming die assembly, connected to the opposite end of each vertical support member, is able to be rotationally displaced relative to the ram of the press brake. A hemming die, coactable with the work table, or flat hemming die, of the press, is connected to the bottom of the hemming die assembly to form a hem on the piece of sheet metal.

Finally, means to sequentially and substantially vertically displace the hemming die assembly relative to the ram, and to position the assembly adjacent to and partially below the ram of the press, is provided.

The present invention also includes a method aspect which involves the formation of a hem on a piece of sheet metal using a hemming die fixture in accordance with the present invention.

BRIEF DESCRIPTION OF THE DRAWINGS

FIG. 1 also shows a full bend being formed on a piece of sheet metal.

DETAILED DESCRIPTION OF THE PREFERRED EMBODIMENT

Figure 3:
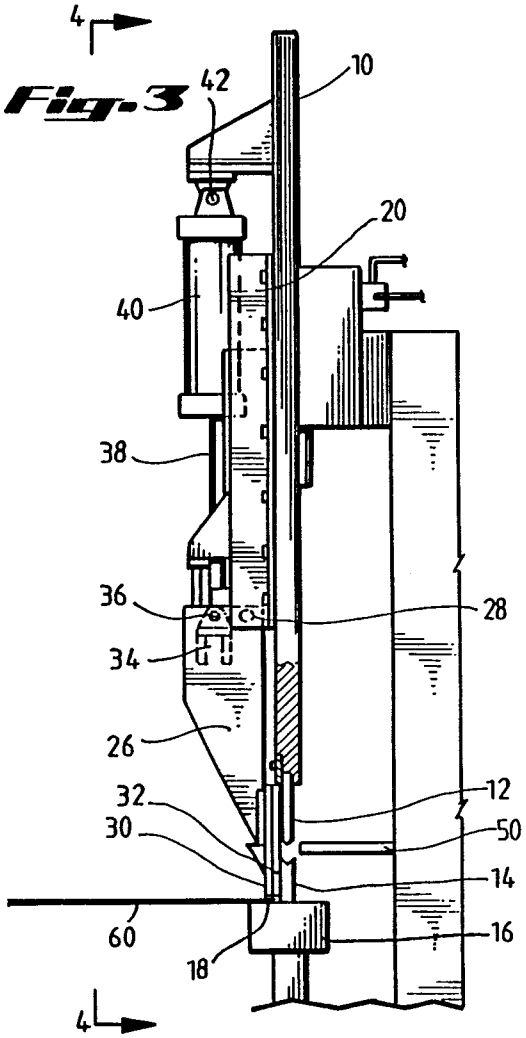
FIG. 3 is a side view of the press brake and hemming die fixture shown in FIG. 2, wherein the hemming die is shown coacting with the work table of the press to form a hem on a piece of sheet metal.
Figure 2:
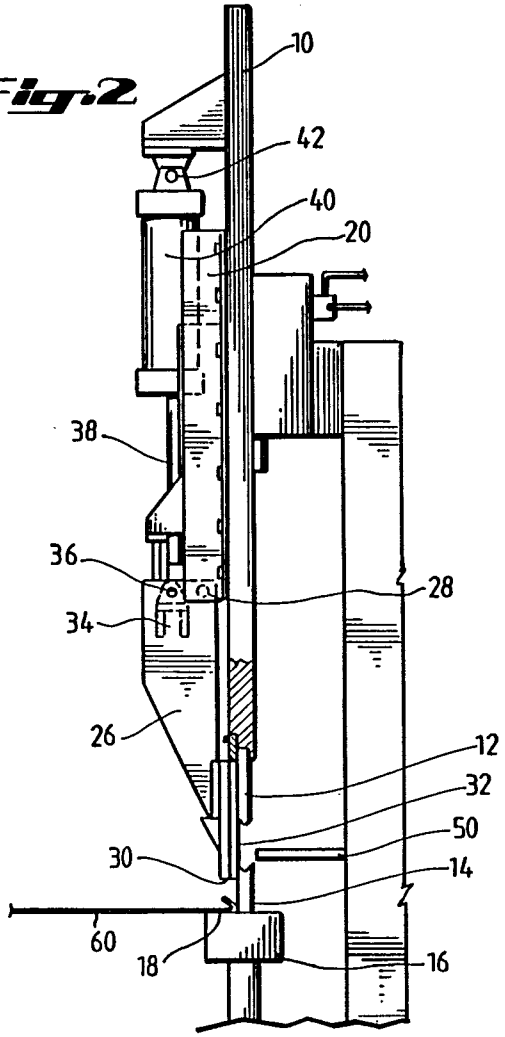
FIG. 2 is a side view of the press brake and hemming die fixture shown in FIG. 1, wherein the hemming die fixture has been actuated to a working position.

Referring to FIG.s 1 and 4, a hemming die fixture 70 according to the present invention is shown attached to the ram 10 of a metal press, or press brake. The hemming die fixture 70 is attached to the front face of a ram 10 of a metal press with mounting brackets 20. Mounting brackets 20 are, in turn, attached to the ram 10 in an opposed, parallel, and substantially vertical relation. In an apparatus according to a preferred embodiment of the present invention, a pair of mounting brackets 20 are bolted to the front face of ram 10 so that each bracket 20 is positioned approximately midway along the vertical width of the ram 10. In a preferred embodiment of the present invention, mounting brackets 20 may be angle-shaped members with one leg on the angle being attached to the front face of the ram 10 so that the other leg of the angle-shaped mounting bracket 20 is directed toward the center of the ram 10.

A separate vertical positioning brace 22 is attached to each mounting bracket 20 so that the vertical positioning brace 22 is able to slide along the vertical length of the mounting bracket 20.

Suitable means to connect each mounting bracket 20 with its respective vertical positioning brace 22, so as to enable brace 22 to slide along the projecting leg of bracket 20, are well known in the art. Such means may include, for example, bearings provided on braces 22 which coact with raceways or guiderails provided along the vertical length of the projecting legs of the mounting brackets 20. Similarly, the sliding relationship between braces 22 and brackets 20 may simply be accommodated by a greased track formed by the projecting leg of each bracket 20, upon which each respective brace 22 slides. Such structure is well known in the art. In one preferred embodiment of the invention, therefore, each vertical positioning brace 22 is attached to the leg of its respective mounting bracket 20 which extends away from the face of the ram 10 so that it is directed toward the center of the ram 10, and thereby faces an opposed, vertical positioning brace 22, attached to an opposite mounting bracket 20.

A vertical support member 26 is rotatably attached to the bottom of each vertical positioning brace 22 so that the vertical support member 26 is capable of rotational movement relative to the front face of the ram 10, in a plane perpendicular to the front face of the ram 10. The opposite end of each vertical support member 26 is connected to a carrier plate, or hemming die assembly 30.

The carrier plate 30 is a substantially horizontal member which is connected to the vertical support members so that it is substantially parallel to the bottom longitudinal edge of the ram 10. A hemming die 32, used to compress a full bend formed along a longitudinal edge of a piece of sheet metal 60, is provided along the bottom of the carrier plate, or hemming die assembly 30.

Figure 4:
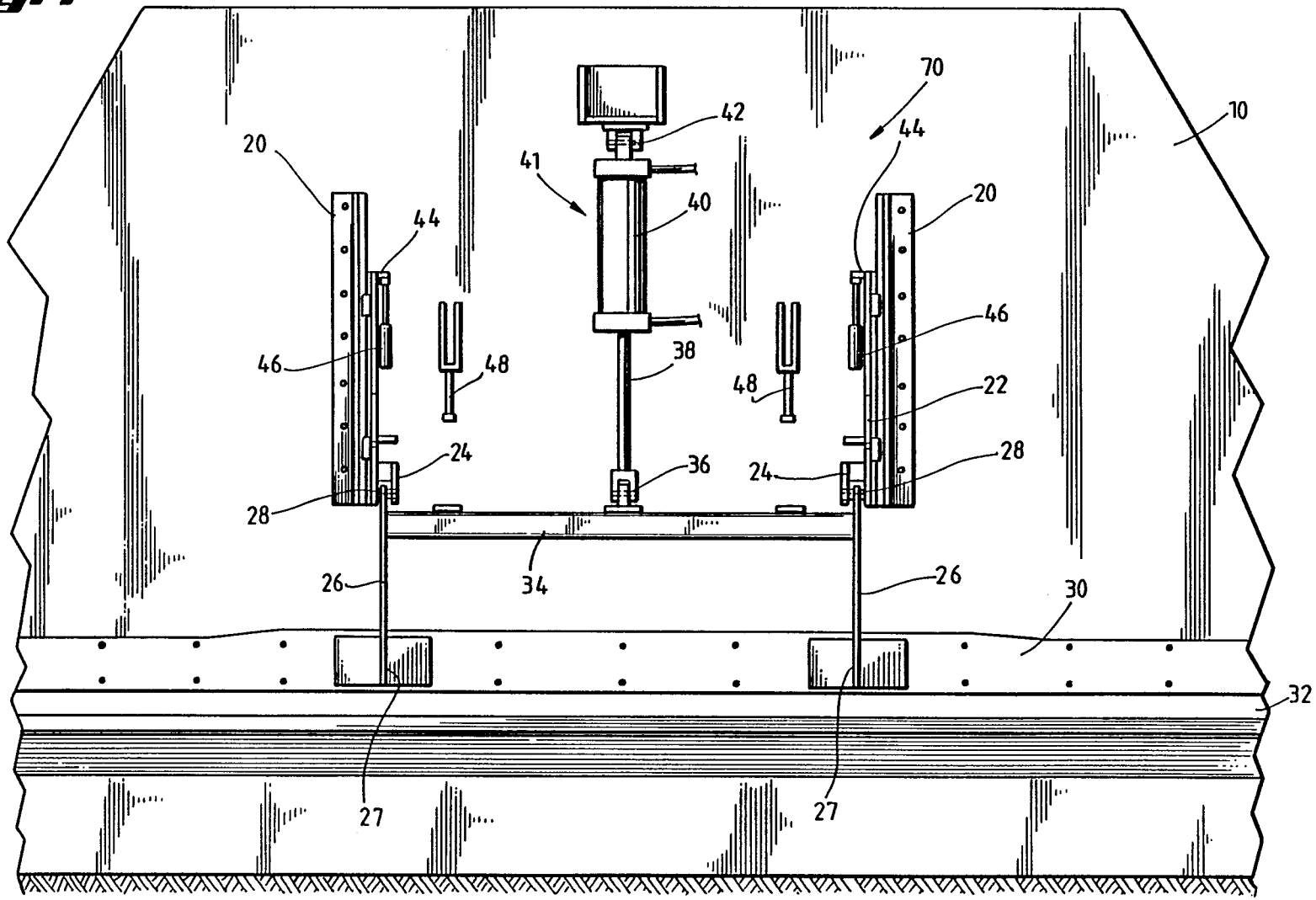
FIG. 4 is a front view of a press brake and hemming die fixture according to the present invention.

Referring specifically to FIG. 4, a horizontal brace 34, extends between, and is attached to, each vertical support member 26.

Finally, and still referring to FIG. 4, means 41 is provided to sequentially and substantially vertically displace the hemming die assembly 30, by raising and lowering the hemming die assembly 30 so that vertical positioning braces 22 slide along mounting brackets 20. The means 41 to sequentially and vertically displace the hemming die assembly 30, positions the assembly 30 adjacent to, and partially below, the ram 10 of the press to a working position.

Alternatively, means 41 displaces the assembly 30 to a standby position, adjacent to, and above, the bottom of the ram 10 by raising the hemming die assembly 30. The hemming die assembly 30 is raised until horizontal brace 34 encounters two stops 48 provided on the face of the ram 10. In a preferred embodiment of the present invention, means 41 is a hydraulic or pneumatic piston and cylinder arrangement. In one embodiment of the invention, a hydraulic cylinder 40 is attached at an end 42 to the face of the ram 10 so that the cylinder 40 is capable of rotational movement relative to the ram 10, in a plane perpendicular to the face of the ram 10. An end 36 of a piston 38, extending out of the opposite end of the cylinder 40, is rotatably attached to the midsection of the horizontal brace 34. In this embodiment, the rotatable connection, between the end 36 of piston 38 and the horizontal brace 34, is located at a perpendicular distance, measured from the face of the ram 10, that is greater than the rotatable connections joining the vertical support members 26 to their respective vertical positioning braces 22.

Figure 1:
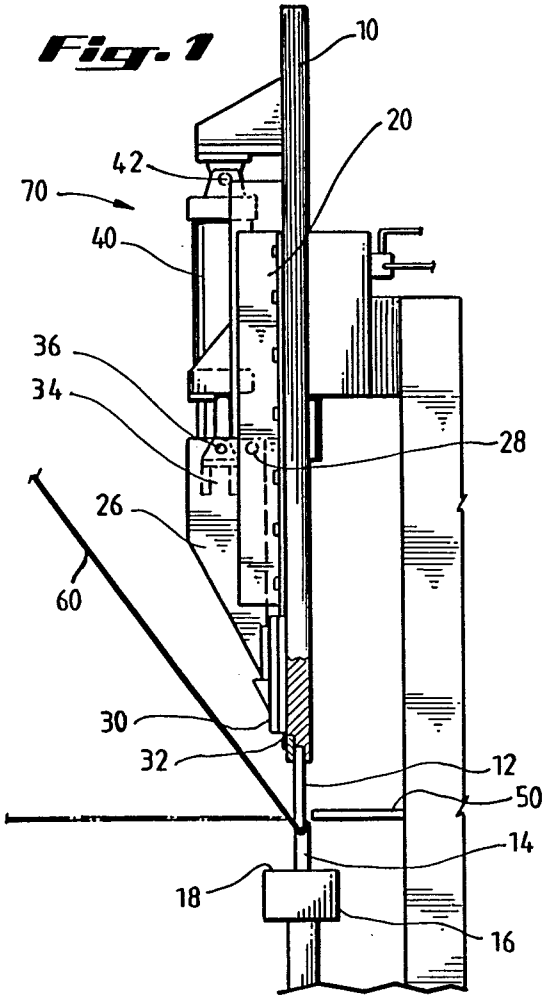
FIG. 1 is a side view of a press brake with a hemming die fixture according to the present invention attached and in a standby position.

In the above embodiment of the present invention, the hemming die assembly 30 may be positioned to a working position which is parallel to, and partially below, the ram 10 so that a portion of the hemming die assembly 30 is positioned beneath the ram 10. Whem hemming die assembly 30 is so positioned, axial load applied to the hemming die assembly 30 may be transmitted to the ram 10. In this manner, the hemming die assembly 30 may be used to form a hem on a piece of sheet metal 60 in a horizontal plane beneath the horizontal plane in which the primary die 12 of ram 10 coacts with its respective bottom die 14 (See FIG. 1) to form a "full bend" along the edge of the sheet metal 60.

When displacing the hemming die assembly 30 into the working position, the cylinder 40 and piston 38 force horizontal brace 34 downwardly. This, in turn, causes the vertical support members 26 to be pushed downwardly, thereby sliding each vertical support brace 22 down its respective mounting bracket 20. Each vertical support brace 22 is slid downwardly along its respective mounting bracket 20 until a motion limiting shoulder 44, provided at the top of each vertical support brace 22, comes into contact with a stop 46 provided on the face of the ram 10. When each shoulder 44 contacts its respective stop 46, the downward force applied by the piston 38 is transformed into rotational movement about connection 36 which causes the hemming die assembly 30 to be rotationally displaced toward the ram 10 about joints 28, and into contact with the bottom of ram 10. In yet another embodiment of the invention, additional piston and cylinder combinations may be used to bias the hemming die assembly 30 through its rotational movement, and into a locked, working position.

Still referring to FIG.s 1 and 4, in another embodiment of the present invention, a hemming fixture 70 is combined with a metal press having a vertically displaceable ram portion 10, and a substantially immoveable work table 16. Work table 16 is positioned beneath the ram 10, and has at least two work surfaces 18 and 14, each work surface being at a separate vertical elevation.

In this embodiment, a primary bending die 12, attached along the bottom edge of the ram 10, is adapted to coact with a bottom die 14 provided with a first work surface, to form a full bend along the edge of a piece of sheet metal 60 when the ram 10 is lowered to the work table 16.

Referring specifically to FIG. 4, mounting brackets 20 are attached to a front face of the ram 10 in an opposed, substantially vertical relation, the brackets being positioned parallel to one another midway down the face of the ram 10.

A separate linear bearing plate 22 is connected to each mounting bracket 20 so that it is able to slide up and down the length of its respective bracket 20. A separate linear bearing plate 22 is connected to each mounting bracket 20 so that it is able to slide up and down the length of its respective bracket 20. As indicated above, bearing plates 22 may be attached to the mounting brackets 20 in any number of ways so as to permit the plates 22 to be slidingly displaced along the vertical length of the mounting brackets 20. These arrangements are well known in the art, and may be, for example, an arrangement whereby the brackets 20 provide a greased track upon which the bearing plates slide in an interference-type relation. The bearing plates 22 are connected to their respective mounting brackets 20 so that opposed linear bearing plates 28 face each other toward the center of the ram 10, in a substantially parallel relation.

An inner bearing member or plate 24 is coupled to each linear bearing plate 22, and is held a predetermined distance away from its respective bearing plate 22, toward the center of the ram 10, by spacers so that a vertical carrier plate 26 may be received between them. An end of a separate vertical carrier plate 26 is positioned in the annulus between each linear bearing plate 22 and inner bearing plate 24 combination, and is rotatably attached to its respective linear bearing plate 22 and inner bearing plate 24 so that it is capable of rotational movement in a vertical plane perpendicular to the face of the ram 10.

In a preferred embodiment of this invention, a pair of mounting brackets 20, and therefore a pair of linear bearing plates 22, inner bearing plates 24 and vertical carrier plates 26, are used. In this embodiment, a single horizontal brace 34 extends between the vertical carrier plates 26 and is fixedly attached at a separate end to the opposed vertical carrier plates 26. The horizontal brace 34 is attached to the vertical carrier plates at a point along the midsection of the length of the vertical carrier plates 26.

A horizontally positioned hemming die support 30 is attached to the bottom end 27 of each vertical carrier plate 26. The hemming die support 30 is attached to each vertical carrier plate 26 so that the bottom edge of the hemming die suport 30 is substantially parallel to the bottom edge of the ram 10. A hemming die 32 is attached to an inside surface of the hemming die support 30, toward the ram 10, a predetermined distance from the hemming die support 30 so that the hemming die support will not interfere with the primary die 12, attached to ram 10, when the hemming die support 30 is in a working position.

Finally, means 41 are provided to vertically displace the hemming die support 30 by drawing the hemming die support 30 upwardly, out of position, and away from the primary die 12; until horizontal brace 34 contacts the stops 24 provided on the face of the ram 10 and to displace the hemming die support 30 downwardly, into a working position adjacent, and parallel to, the primary die 12 until motion limiting shoulders 44 contact stops 46, also provided on the face of the ram 10. In this embodiment, means 41 may be a hydraulic or pneumatic piston and cylinder combination as described above.

Referring now to FIG.s 1 through 4, when forming a hem according to the present invention along an edge of a piece of sheet metal 60, the sheet metal 60 is placed on a first working surface 14 of a work table 16, so that an edge of the sheet metal 60 lies in a plane parallel to a bottom die fixed along the first working surface 14. The sheet metal 60 may be inserted a predetermined distance into the sheet metal press by inserting the sheet metal 60 into the press until the edge of the sheet metal 60 encounters a stop, on guide 50.

Once the sheet metal 60 has been inserted into the metal press, or press brake, the metal press is actuated so that a ram, or ram assembly 10 positioned above the work table 16 is lowered so that a primary die, or first primary hemming die 12, fixed to a longitudinal bottom edge of the ram 10, coacts with the bottom die positioned along the first working surface 14. When the primary die 12 coacts with the bottom die in the first working surface 14, the sheet metal 60 is deformed, thereby forming a full bend along the longitudinal edge of the sheet metal 60. When the full bend of the sheet metal 60 is taken in cross-section, it resembles a hook-shape with the actual edge of the sheet metal being directed back over the main body of the sheet to form the end of the "hook".

After the full bend has been formed along the edge of the sheet metal 60, the ram 10 is displaced upwardly, away from the first working surface 14, thereby releasing the sheet metal 60.

The sheet metal 60 is then repositioned to a second working surface 18 on the work table 16. The second working surface 18 is located in a different vertical plane, than the first working surface 14. In a preferred embodiment, the second working surface 18 will be several inches lower than the first working surface 14. The longitudinal edge of the sheet metal 60 is positioned so that the full bend along the edge is parallel to the bottom die and the bottom of the ram 10.

A hemming fixture 70 is then engaged so that a hemming die assembly 30 is automatically displaced along the front face of the ram 10 until it is locked into a working position between the bottom of the ram 10 and the work table 16. When positioned in this working position, a hemming die 32 is adjacent and parallel to the primary die 12.

The metal press is again engaged so that the ram 10 is lowered a second time. The ram 10 is lowered until the primary die 12 is again brought into relative engagement with the bottom die located in the first working surface 14, while the hemming die 32 simultaneously coacts with the second working surface, or second flat hemming die 18 to compress the full bend of the sheet metal 60, thereby forming a hem along the longitudinal edge of the piece of sheet metal 60.

After the hem has been formed, the ram 10 is again raised away from the work table 16. The hemming die fixture 70 is simultaneously raised to a standby position. To achieve the standby position, the hemming die fixture 70 raises the hemming die assembly 30 upwardly along the face of the ram 10 until the hemming die assembly 30, and hence the hemming die 32, is away from, and clear of, the primary die 12. This positioning is somewhat adjustable with stops 48.

In this manner, a hem may be formed along the edge of a number of sheet metal pieces quickly and efficiently.

Various modifications and improvements may be made to the disclosed embodiments without departing from the overall scope and spirit of the invention. For example, means, other than a hydraulic or pneumatic piston and cylinder combination, may be used to lower and raise the hemming die assembly into working and standby positions. Similarly, the sliding connection between the mounting brackets and the linear bearing members may be altered. Finally, the hemming die fixture may be activated so as to form a hem that is either partially open or substantially flattened and closed.

Having therefore full and completely disclosed the best best mode of our invention, we now claim:

1. A metal press and hemming fixture apparatus for forming a hem in a piece of sheet metal, comprising:

a metal press having a vertically displaceable ram portion and a substantial immoveable work table;

said work table being provided beneath said ram and having at least two work surfaces, each said work surface being at a different vertical elevation;

a primary bending die attached along the bottom of said ram, said primary die adapted to coact with a first said work surface to form a full bend on said piece of sheet metal when said ram is lowered to said first work surface;

mounting brackets attached to a front face of said ram in an opposed, substantially vertical and laterally spaced parallel relation to one another;

a separate linear bearing plate slidably connected to each said mounting bracket such that an inwardly facing surface of each said linear bearing plate is directed to an opposed, substantially parallel, inwardly facing surface of an adjacent linear bearing plate, and such that each said bearing plate is vertical displacement along its respective mounting bracket;

a separate inner bearing member coupled to each said linear bearing plate in spaced relation to said plate and slidable with its respective linear bearing plate relative to its respective mounting opposed surfaces of adjacent said inner bearing members facing each other in spaced, parallel relation;

a separate vertical carrier plate rotatably attached at an end between each said linear bearing plate and inner bearing member combination;

a horizontal brace extending between said vertical carrier plate supports, said brace being connected at each end to a separate carrier plate support;

a horizontally positioned hemming die support attached to the free end of each said vertical carrier plate, the bottom edge of said hemming die support being substantially parallel to the bottom of said ram;

a hemming die positioned along the bottom edge of said hemming die support; and means to vertically displace said hemming die support to draw said hemming die support upwardly out of position and away from said primary die, and to displace said hemming die support downwardly into working position adjacent and parallel to said primary die.

2. The metal press and hemming fixture apparatus according to claim 1, wherein the number of mounting brackets is two.

3. The metal press and hemming fixture apparatus according to claim 1, wherein each said inner bearing member is positioned parallel to the other and is further positioned relative to its respective mounting bracket toward the center of said ram, so as to provide the sliding connection between bearing plates and bearing members, and mounting brackets so as to enable vertical movement of the bearing plates up and down the vertical length of the mounting brackets, while inhibiting horizontal movement of the bearing plates relative to the mounting brackets.

4. The metal press and hemming fixture apparatus according to claim 1, wherein said hemming die is attached to an inside surface of said hemming die support toward said ram, and is positioned a predetermined distance from said hemming die, so that said hemming die support will not interfere with said primary die when said hemming die support is in said working position.

5. The metal press and hemming fixture apparatus according to claim 4, wherein said hemming die is placed below said primary die in said working position, so that said hemming die forms a hem on a second work surface, below said first work surface, upon which said primary die coacts to form said full bend.

6. The metal press and hemming fixture apparatus according to claim 1, wherein said means to vertical displace said hemming die support positions said hemming die into said working position below said primary die.

7. The metal press and hemming fixture apparatus according to claim 5, wherein said means to vertically displace said hemming die support is a hydraulic piston and cylinder combination, said cylinder being rotatably attached at an end to said ram between said mounting brackets, an end of said piston exiting out of the opposite end of said cylinder, said extended end of said piston being rotatably attached to the midpoint of said horizontal brace.

8. The metal press and hemming fixture apparatus according to claim 7, wherein said rotatable connection of said piston to said horizontal brace is in a vertical plane different than the vertical plane of said rotatable connection connecting said vertical carrier plates and their respective linear bearing plate and inner bearing plate combination.

9. A method of forming a hem on a piece of sheet metal, comprising the steps of:

placing a piece of sheet metal on a first, fixed working surface of a stationary work table so that a longitudinal edge of said sheet metal lies in a plane parallel to a stationary longitudinal bottom die providing said first, fixed, working surface;

actuating a ram, positioned above said work table, to be displaced vertically so that a primary die attached to a longitudinal bottom edge of said ram, coacts with said first, fixed, working surface of said stationary bottom die to deform said sheet metal located there between, thereby forming a full bend along said longitudinal edge of said sheet metal;

displacing said ram upwardly, away from said first, fixed, working surface thereby releasing said sheet metal;

repositioning said sheet metal to a second fixed, lower, working surface on said work table, said second, fixed, working surface being located in a different horizontal plane than the first, fixed, working surface and adjacent to said first working surface, said longitudinal edge of said sheet metal being positioned so that said full bend formed along said edge is parallel to said bottom die and said ram, and abuts against said bottom die;

said stationary bottom die thereby providing an alignment stop for said sheet metal;

engaging a hemming die assembly so that a hemming die is automatically displaced along a front face of said ram until it is locked into a working position below and adjacent to said primary die, and above said lower, fixed, second working surface on said stationary work table; and actuating said ram a second time so that said primary die is again brought into relative engagement with said bottom die, while said hemming die simultaneously coacts with said fixed, second, lower working surface to compress said full bend of said sheet metal, thereby forming a hem along the longitudinal edge of said piece of sheet metal.

10. The method according to claim 9, which further comprises displacing said hemming die assembly to a standby position along the front face of said ram after said hem has been formed along said longitudinal edge of said piece of sheet metal.

11. A method of hemming an edge of a sheet of metal, wherein the edge is bent by being pressed between a ram and a face on a fixed work table, comprising the steps of:

(a) arranging stationary first and second bottom dies side-by-side with said first bottom die spaced above the second bottom die;

(b) aligning a reciprocatable ram having a primary die at its lower end configured to coact with the first stationary bottom die to impart a full bend to an edge of a metal sheet upon an axial ramming stroke of the ram and the primary die toward said first bottom die;

(c) attaching a hemming die to the ram in axially movable relation with the ram between lower and upper limiting positions, the lower limiting position being in alignment with the lower second bottom die and adjacent to said primary die such that the hemming die in the lower limiting position upon a ramming stroke of the ram coacts with the second, lower, fixed bottom die to hem an edge of a metal sheet having a full bend, the upper limiting position being such that the hemming die is above and adjacent to the primary die;

(d) placing an edge of a first metal sheet across and over the second bottom die and along the first bottom die;

(e) pressing the edge of the first sheet between the primary die and the first stationary bottom die to form a full bend along the edge while maintaining the hemming die in said upper limiting position sufficiently above and alongside the primary die such that the hemming die is clear of the first sheet during the pressing;

(f) retracting the ram from the ramming stroke;

(g) moving the metal sheet such that the fully bent edge lies on the lower, stationary second bottom die and abuts against said stationary first bottom die, said fully bent edge being in alignment with the hemming die in its lower limiting position;

(h) moving the hemming die axially relative to the ram to said lower limiting position, beneath and alongside said primary die;

(i) ramming the hemming die toward the second stationary bottom die to hem the complete bent edge;

(j) retracting the ram from the ramming stroke;

(k) moving the hemming die to its upper limiting position adjacent to said primary die; and (l) repeating steps (d) through (j) for a second metal sheet.

12. A method of hemming an edge of a metal sheet using a ram which is axially and reciprocally movable toward and away from a stationary work table, comprising the steps of:

alignment a first, full bend, top die and second, flattening, top die in side-to-side and axially adjustable relation on the ram to be reciprocally movable along with axial movements of the ram toward and away from the work table;

supporting a first, fixed, full bend, bottom die from and above the stationary work table in alignment with the first top die to receive and impart a full bend to an edge of a metal sheet at the lower limit of movement of the ram and the first top die toward the work table;

supporting a second, fixed, flattening bottom die from the stationary work table and vertically between the work table and the first bottom die and in alignment with the second top die to flatten a fully bent edge of a metal sheet at the lower limit of movement of the ram and the second die toward the work table;

positioning a first metal sheet in a first pressing position above the second, fixed, bottom die and on the first, fixed, bottom die, with the edge of the first metal sheet aligned with the first top die to experience a full bend upon movement of the ram to the lower limit of its movement toward the stationary work table;

positioning the second top die axially to a first position away from and above the stationary work table a distance sufficient to enable the edge of the first metal sheet to experience a full bend when the first metal sheet is in its first pressing position;

moving the ram to the lower limit of its movement toward the work table to impart a full bend to the edge of the first sheet in its first pressing position;

moving the ram axially away from its lower limit of movement to a second, upper limiting position away from the stationary work table;

moving the first metal sheet to a second, lower pressing position with its fully bent edge on the second bottom die and abutting said full bend die to experience a flattening bend upon movement of the ram toward the work table;

moving the second top die axially relative to the ram and the first top die toward the stationary work table to a second position below and adjacent to the first top die and aligned with the second fixed bottom die and the fully bent edge to enable the fully bent edge to be flattened between the fixed second bottom die and the second top die when the ram is at the lower limit of its movement toward the work table;

moving the ram to the lower limit of its movement toward the work table to flatten the full bent edge;

moving the ram to the upper limit of its movement; and removing the first metal sheet from the work table.

* * * * *

UNITED STATES PATENT AND TRADEMARK OFFICE

CERTIFICATE OF CORRECTION

PATENT NO. : 4,805,438

DATED : February 21, 1989

INVENTOR(S) : Albert R. Ginn; Lynn Widrick

It is certified that error appears in the above-identified patent and that said Letters Patent is hereby corrected as shown below:

Col. 8, line 21, change "vertical" to --vertically--.

Col. 8, line 26, change "claim 5" to --claim 6--.

Signed and Sealed this

Twenty-third Day of January, 1990

*Attest:*

JEFFREY M. SAMUELS

*Attesting Officer*

*Acting Commissioner of Patents and Trademarks*